US005899144A

United States Patent [19]

Parks

[11] Patent Number: 5,899,144

[45] Date of Patent: May 4, 1999

[54] PRINTED METALLIZED RIBBONS AND METHOD FOR MAKING SAME

[75] Inventor: Jack D. Parks, Montgomery, Ala.

[73] Assignee: Boosters, Inc., Montgomery, Ala.

[21] Appl. No.: 08/843,635

[22] Filed: Apr. 10, 1997

[51] Int. Cl.[6] ..... A41M 1/12

[52] U.S. Cl. ..... 101/129; 205/164

[58] Field of Search ..... 101/129, 114; 205/164, 159, 194, 196, 224; 428/199, 201, 209

[56] References Cited

U.S. PATENT DOCUMENTS

| | | | |
|---|---|---|---|
| 4,816,321 | 3/1989 | Pickering | 428/199 |
| 5,040,296 | 8/1991 | Yerger | 30/81 |
| 5,294,494 | 3/1994 | Yang | 428/426 |
| 5,362,374 | 11/1994 | Chang | 205/164 |
| 5,427,235 | 6/1995 | Powell et al. | 206/245 |

FOREIGN PATENT DOCUMENTS

WO 82/03202 9/1982 WIPO .

WO 94/29127 12/1994 WIPO .

*Primary Examiner*—Christopher A. Bennett

*Attorney, Agent, or Firm*—Fitzpatrick, Cella, Harper & Scinto

[57] ABSTRACT

A process of forming a plurality of substantially identical printed ribbons from a single length of rolled tape, includes unrolling the tape, repeatedly silk-screen printing a wet ink pattern onto a side of the tape, along the length of the tape, as the tape is unrolled, cutting the printed tape into a plurality of ribbons all having substantially the same length and all bearing substantially the same ink pattern, and drying the wet ink. The improvement includes wherein the tape that is used includes a polymer substrate that is metallized on both sides, with at least the side that is printed upon having a top layer of an ink-receptive coating. A printed ribbon includes a ribbon substrate and an ink pattern silk-screen printed onto one side of the ribbon substrate. The improvement includes wherein the ribbon substrate includes a polymer substrate includes that is metallized on both sides with an ink-receptive coating disposed at least on the side that is printed upon.

26 Claims, 7 Drawing Sheets

PRINTED METALLIZED RIBBONS AND METHOD FOR MAKING SAME

The present invention relates to printed metallized ribbons, and more specifically to silk-screen printed, double-metallized ribbons and a process for making such ribbons.

BACKGROUND OF THE INVENTION

Printed ribbons are a popular way to recognize achievements or show support at social, athletic, academic and political functions. The ribbons can be adorned with any of an infinite number of designs or text. In a typical printed ribbon production operation, rolls of ribbon-material tape are processed into individual printed ribbons. The tape, generally produced in the desired width of the finished ribbons, is unspooled from the rolls and printed with a desired pattern. In some operations, the printed tape is next cut into individual ribbon lengths, then dried by some combination of heaters and blowers, and fed to a stacker that guides the dried ribbons into stacks for boxing. In other operations, the printed tape is dried first, then cut into ribbons.

In processing a roll of tape into individual printed ribbons, control of the timing of the various operations is important. Various rollers and belts must incrementally advance the tape for each print cycle, in synchronization with the operation of the printer, the cutter, and the drier, in order to print the tape at proper intervals and cut ribbons of the proper length.

Traditionally, printed ribbons are formed of a woven material, usually satin. This material has been very successfully employed, but raises several production concerns. In most operations, the tape rests on a printing surface or platen as a printing head lowers onto and applies ink to the tape. During printing, ink can penetrate the woven material, often soaking through to the platen. As ink builds up on the platen, it gets tacky. The woven tape then sticks to the platen, preventing the tape from being properly advanced in synchronization with the printing and cutting operations. In order to remedy this, the operation must periodically be interrupted, usually once or twice during a typical run of about two hundred ribbons, in order to clean the platen to insure that the process can continue smoothly.

Further, in many printing operations, a vacuum or the like draws air through a porous platen to hold the tape in position for printing. Just as the platen can get tacky during a print run, so can the printing head, which can cause the tape to stick to the printing head as it retracts after printing. Because air passes easily through porous woven ribbon material, the vacuum under the platen is often unable to hold down tape which has adhered to the retracting print head, which can smudge the wet ink, ruining the ribbon. Additionally, woven ribbon material is relatively flimsy, causing it to sometimes stick to the platen or other parts of the machine, as it is fed by the rollers. This sticking problem is particularly troublesome at points in the operation where rollers or belts advance the tape from behind, for example, to position the tape for cutting. If sticking occurs at one of these locations, it can lead to mistakes in printing or cutting, as well as complications in stacking and boxing.

In addition to production concerns, the satin ribbon has limitations that restrict its commercial appeal. A trend has evolved in the decorating and gift wrap industries to employ polyvinyl chloride (PVC or vinyl) sheets that are metallized on one side ("single-metallized" ), giving the material a brilliant, shiny look. It is desirable to provide ribbons which give a similar visual impression, but which better lend themselves to being printed upon than single-metallized vinyl ribbons. Vinyl is quite heat sensitive, making it challenging to dry the ribbons quickly. Traditional drying temperatures can ruin the ribbons. Higher blower speeds can compensate for the lower temperatures, but can blow the ribbons out of position and complicate stacking and boxing. Thus, production speeds must decrease if single-metallized vinyl ribbons are to be allowed to dry properly at lower temperatures. In addition, ribbons formed of the vinyl material do not stand up well to storage in hot environments. The ribbons will often curl or melt if left in a non-ventilated store room or vehicle on a hot day.

Static electricity also poses a major barrier to the use of a vinyl material in the above-described processes, especially where silk-screen printing techniques are employed, resulting in even further production delays. As discussed, the timing of the various steps in the printing operation is important, and this can be very difficult to maintain if static electricity is not adequately controlled. If the rollers and belts cannot properly advance the tape in synchronization with the timing of these operations, due to static electricity, production can either grind to a halt or result in worthless ribbons.

Static electricity can cause the tape to stick to rollers so that, instead of advancing, the tape continuously winds back on the rollers, causing the machine to jam. The tape can also cling to the platen so that it will not advance properly, preventing proper printing or cutting. Static electricity build-up can cause the tape to cling to other parts of the machinery as well, so that the tape will not properly feed past the cutter, resulting in uneven cuts and worthless ribbons. Also, once cut, the still-wet ribbons can cling to the cutter itself or the nearby machinery, again interrupting the process and usually smudging the ink, rendering more ribbons worthless. Once cut, the single-metallized vinyl ribbons are typically very light, and any excess static charge can cause the ribbons to repel one another, or the machinery, and jump out of alignment, requiring the operator to individually sort the ribbons by hand. As for those ribbons that do make it to the end of the printing line, they can cling to the stacker rather than sorting neatly. Each of these consequences of the build-up of static electricity can contribute to a major overall drain on production levels.

In order to reduce such detrimental effects of static electricity, use of certain static elimination devices can be helpful. One such device is a static neutralizing bar, a variety of which is commercially available from Simco, a division of Illinois Tool Works Company. These static bars produce an electric field by applying voltage to metal emitters in close proximity to a ground. This field causes nearby air molecules to ionize. As the charged ribbon passes through the field, it will attract the ions to neutralize any charge, helping to reduce the static build-up on either side of the ribbon. However, the cost of these static bars, coupled with the transformers for operating them, can be quite expensive, relative to the overall cost of printing such ribbons. Also, such devices can be introduced only where the printing machinery permits. In a typical operation for printing on satin tape, the use of only one or two such static bars is usually sufficient. In the case of a material such as vinyl, however, for which static is a greater problem, additional static bars will often be required. However, even these measures are usually not sufficient in the case of single-metallized vinyl ribbons.

The various problems caused by static electricity greatly increase labor requirements, reduce productivity, and make it very difficult to fill orders in a timely and cost-effective manner, even with the use of static bars and ionized blowers. With traditional satin ribbons, all that is generally required with this type of printing operation, in addition to the person operating each print head, is one person to catch and box ribbons for each two printing lines. But when printing single-metallized vinyl ribbons, it has been necessary to have many additional workers assigned to each printing line just to pick up, sort and stack the ribbons into boxes, one or two at a time. Even then, substantial amounts of time and material can be wasted, increasing the cost of each production run.

Like the metallized vinyl sheets used in the decorative industries, other single-metallized materials are know in the art. Published application WO 94/29127 of Falaas et al. discusses metallized film, for use in decorative articles, formed of a 20–28 $\mu$m thick polyurethane substrate upon which is deposited a continuous, opaque layer of metal, which can be aluminum. The metallized film can optionally include additional layers such as a primer layer, a color layer, and an overlying, protective clear coat layer.

Published application WO 82/03202 of McDermott discusses a metallized plastic film-coated paper laminate, for use as a decorative wrap, formed of a paper base layer, a polyester film extruded onto the paper base layer, and a metallic layer deposited onto the free surface of the polyester film. A print coat, commonly available from ink manufacturers, may be applied to the metallic layer to enhance its printability, and the metallic layer may also be overprinted with a design.

U.S. Pat. No. 5,427,235 to Powell et al. discusses an overwrap of a cigarette package that includes a polyester film substrate layer, preferably polyethylene terephthalate (PET), having a thickness ranging from about 0.25 to about 1.25 mil. A metal layer 14, preferably aluminum, is disposed on one surface of the substrate layer. The metallized PET film is imprinted on either surface with a printing layer, which may include transparent and opaque inks applied with conventional rotogravure or flexographic printing techniques. Depending upon the ink formulations used, it may be necessary to prime coat the surface of the base layer with an adhesion promoting material, such as polyethylene amine. The films are slit into widths appropriate for the cigarette package overwrapping machinery, and then wound onto rolls. The web is later cut into appropriate lengths to form individual overwraps.

However, none of these single-metallized materials overcomes the static problems discussed above.

It has also been contemplated to metallize a film on both sides ("double-metallize"), for example in the food and film packaging industries, in order to minimize light passage through the packaging.

Also, U.S. Pat. No. 5,362,374 to Chang discusses a method for making a decorative sticker, which includes applying a metal coating to both sides of a 20 $\mu$m thick polyester base film. A binder layer is applied in a predetermined pattern on the top surface of the polyester film, and printing is done with ink and gold foil on the remaining portion of the top surface. The sticker is then cut into the desired shape.

However, none of these materials or disclosures contemplates or suggests any solution to the above-discussed problems of preparing decorative, printed ribbons from a metallized film.

SUMMARY OF THE INVENTION

Accordingly, it is an object of the present invention to provide a printed ribbon production process and a printed ribbon which address the foregoing problems.

It is an object to provide printed metallized ribbons, as well as a process for producing such ribbons.

It is an additional object to provide a printed metallized ribbon which can be produced efficiently and without undue waste in material, labor, or time.

Further, it is an object to provide a process for producing such ribbons efficiently and without undue waste of material, labor, or time.

These and other objects, features, and advantages will be better understood by reference to the description below and the accompanying drawings, in which like-reference numerals indicate like elements.

One aspect of the present invention relates to a process of forming a plurality of substantially identical printed ribbons from a single length of rolled tape, which includes unrolling the tape, repeatedly silk-screen printing a wet ink pattern onto a side of the tape, along the length of the tape, as the tape is unrolled, cutting the printed tape into a plurality of ribbons all having substantially the same length and all bearing substantially the same ink pattern, and drying the wet ink. The improvement includes using as the tape a tape that includes a polymer substrate that is metallized on both sides, with at least the side that is printed upon having a top layer of an ink-receptive coating.

Another aspect of the present invention relates to a printed ribbon which includes a polymer substrate that is metallized on both sides with an ink-receptive coating disposed at least on one side, and an ink pattern silk-screen printed onto the coated side of the substrate.

The polymer substrate can consist essentially of a polyester film, e.g., a film of polyethylene terephthalate. The polymer substrate can have a thickness of between approximately 2 and 4 mils, preferably approximately 3-mil thick. The ink can be an ethyl cellulose lacquer type ink.

DETAILED DESCRIPTION OF THE PREFERRED EMBODIMENTS

FIGS. 1 through 4 illustrate schemically the preferred embodiment of the printed metallized ribbon of the present invention, as well as the process for producing printed metallized ribbons.

The ribbon tape itself includes at its core a polyester substrate, which is metallized on both sides and color coated with an ink receptive coating.

The polyester substrate provides the primary structure for the tape. Preferably the substrate is a film which consists primarily of polyethylene terephthalate (PET), e.g. the film commercially available from Minnesota Mining & Manufacturing Company under the mark MYLAR®. But the substrate can also be formed of other suitable polymers or plastic materials, such as polypropylene, oriented polystyrene, polyethylene, nylon or the like, or a laminate structure of one or more of these. PET has proven to be well suited for the present invention because of its low sensitivity to heat, as compared to polyvinyl chloride (PVC or vinyl). Vinyl and other similar synthetics can be used, but they require special considerations in storage and drying. The thickness of the substrate is selected based on the physical characteristics of the particular polymer in view of the desired weight and flexibility of the finished ribbons. With PET, the preferred thickness is within the approximate range of 2 to 4 mils, preferably about 3 mils.

The substrate is metallized using a conventional vacuum deposition process, in which a layer of metal is applied to the substrate. The metallization process is well known in the art, but must be applied to both sides of the substrate. The metal is preferably applied in a thickness which results in a combined optical density of greater than about 0.6, preferably approximately 3, and most preferably approximately 2.8. The metallizing material can be any of a number of metals, such as aluminum, tin, nickel, copper, or silver, for example. Aluminum is preferred. We have found that if the substrate is metallized on both sides, the resultant tape is much more resistant to static build-up than single-metallized materials, as discussed below.

The metallized substrate is coated on at least one side with an ink-receptive layer. If desired, the coating layer can be pigmented in any desirable color. Preferably, this coating layer is a film formed of a crosslinked polyurethane resin, but may be formed of other suitable resins, and it may be pigmented. The coating layer promotes adhesion of ink to the tape and, if pigmented, lends to the appearance of the tape. Normally the coating will not contribute significantly to the strength or stiffness of the tape, as it constitutes only a minor amount of the weight of the finished tape product, e.g., no more than about 5 or 10 percent.

Figure 1:
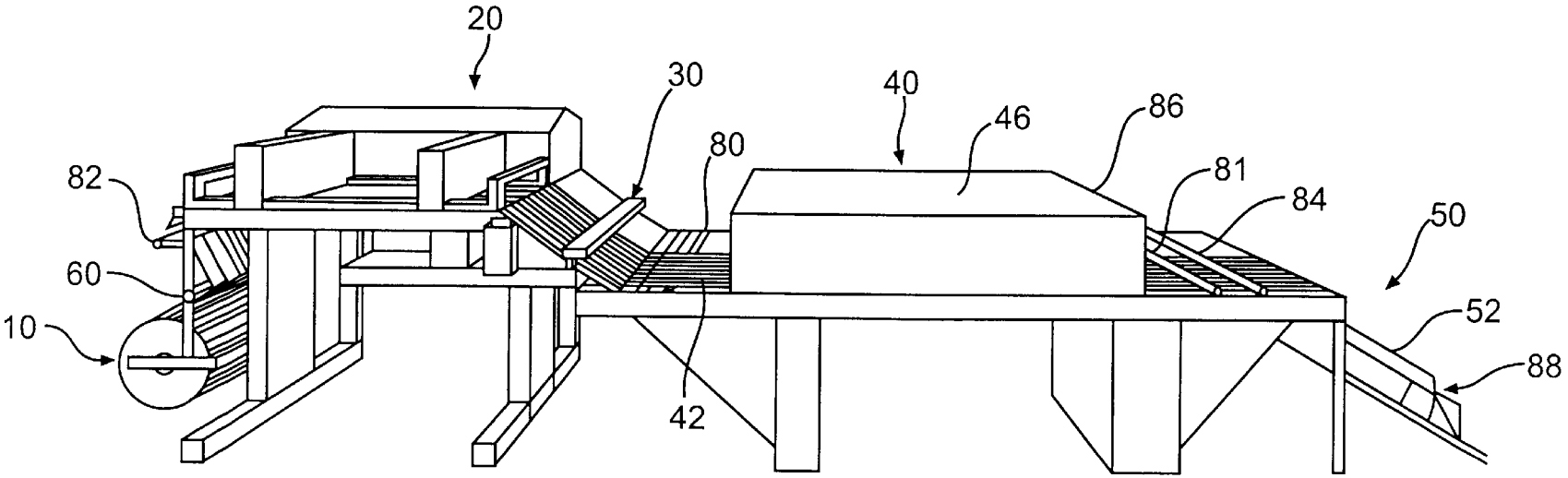
FIG. 1 is a schematic representation of a printing process according to the present invention.

In FIG. 1, which schematically illustrates the overall process, tape is fed from rolls 10 to a printing station 20, at which an ink pattern (e.g., about 6 to 12 inches long) is repeatedly printed on the tape. Once printed, the tape is fed to a cutting station 30, at which the tape is cut into individual ribbons. The printed, cut ribbons are fed to a drying station 40, in which the ink is dried, and then to a stacking station 50.

Figure 2:
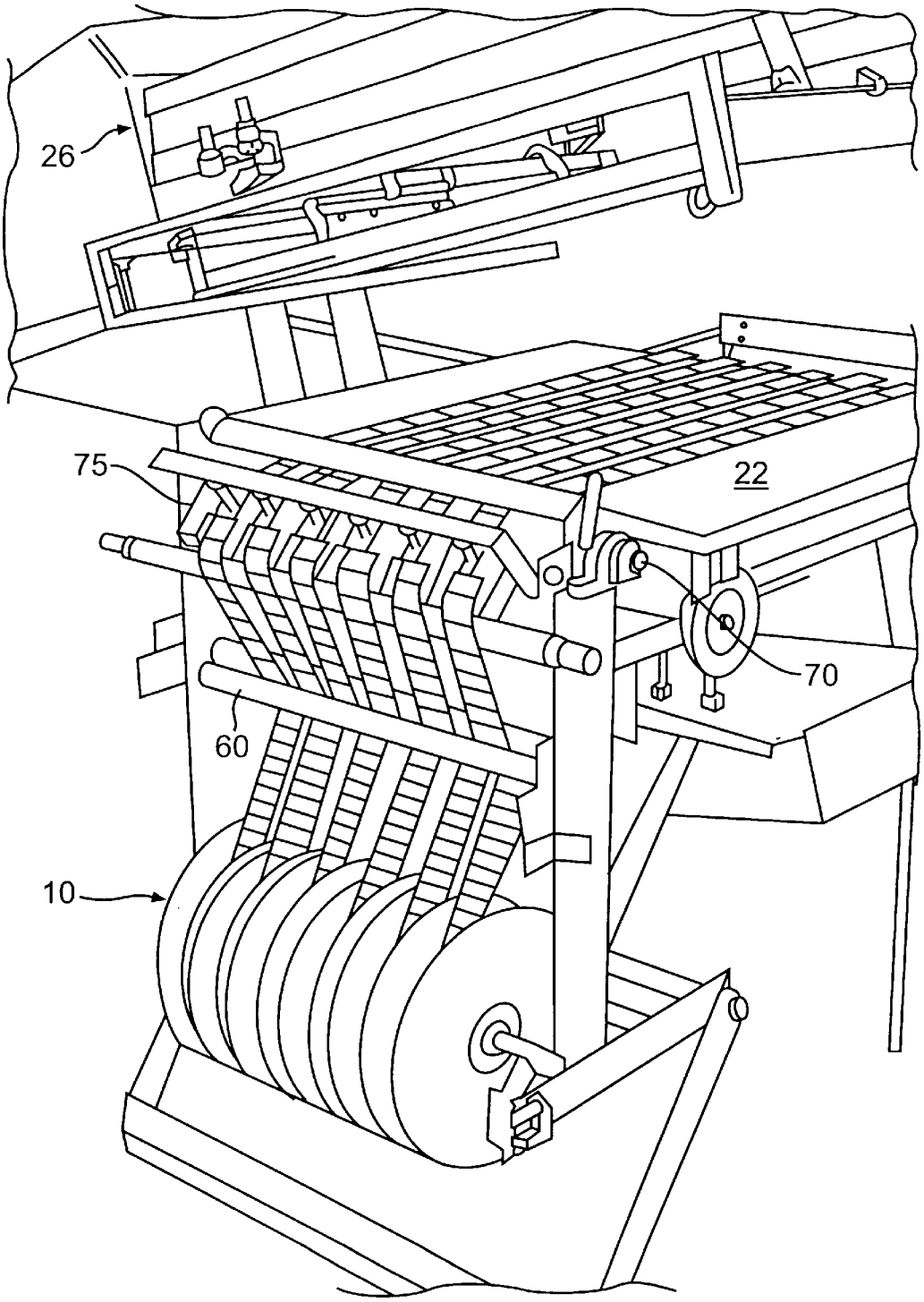
FIG. 2 is a detailed schematic representation of a portion of the process shown in FIG. 1.

Each roll of tape 10 typically contains on the order of 1600 feet of ribbon material in widths of two to three inches. The rolls are wound on cardboard spools with protective flanges and a sufficient core diameter (generally about at least three inches) to reduce curling of the tape. Preferably, the printing machinery can accommodate several of these rolls at once, processing them in parallel. As shown in FIG. 2, six rolls of color tape 10 are loaded at once, with spacer bars assuring correct alignment through the feed system.

To begin the printing and cutting process of the preferred embodiment, a series of take-off rollers 60 is provided to unreel the tape from the spools. Because the weight and inertial resistance of a roll will vary depending upon the amount of tape remaining, the take-off rollers 60 are provided to unwind the tape from the core at a sufficient rate to provide enough slack to allow the downstream processing stations to process the tape at a more or less constant rate. With satin tape, it is often necessary to damp the rotation of the spools, because as the amount of tape decreases, the rolls get very light and can spin freely. Because the metallized polyester is significantly denser and heavier than satin, it is unnecessary to provide such a damping mechanism.

As the take-off rollers 60 unwind the tape from the spool, a series of rubber and metal feed rollers 70 draws the tape incrementally through a series of guides 75, which aligns the ribbon for printing, and feeds the tape downstream onto a printing table 22. The feed rollers 70 advance the tape in increments equal to the length of the finished ribbon product (for purposes of discussion, ten inches). A take-off belt 24, downstream of the printing table 22 and not visible in FIG. 2, helps to keep the tape taut across the printing table, which is preferably formed of a perforated aluminum sheet.

Figure 3:
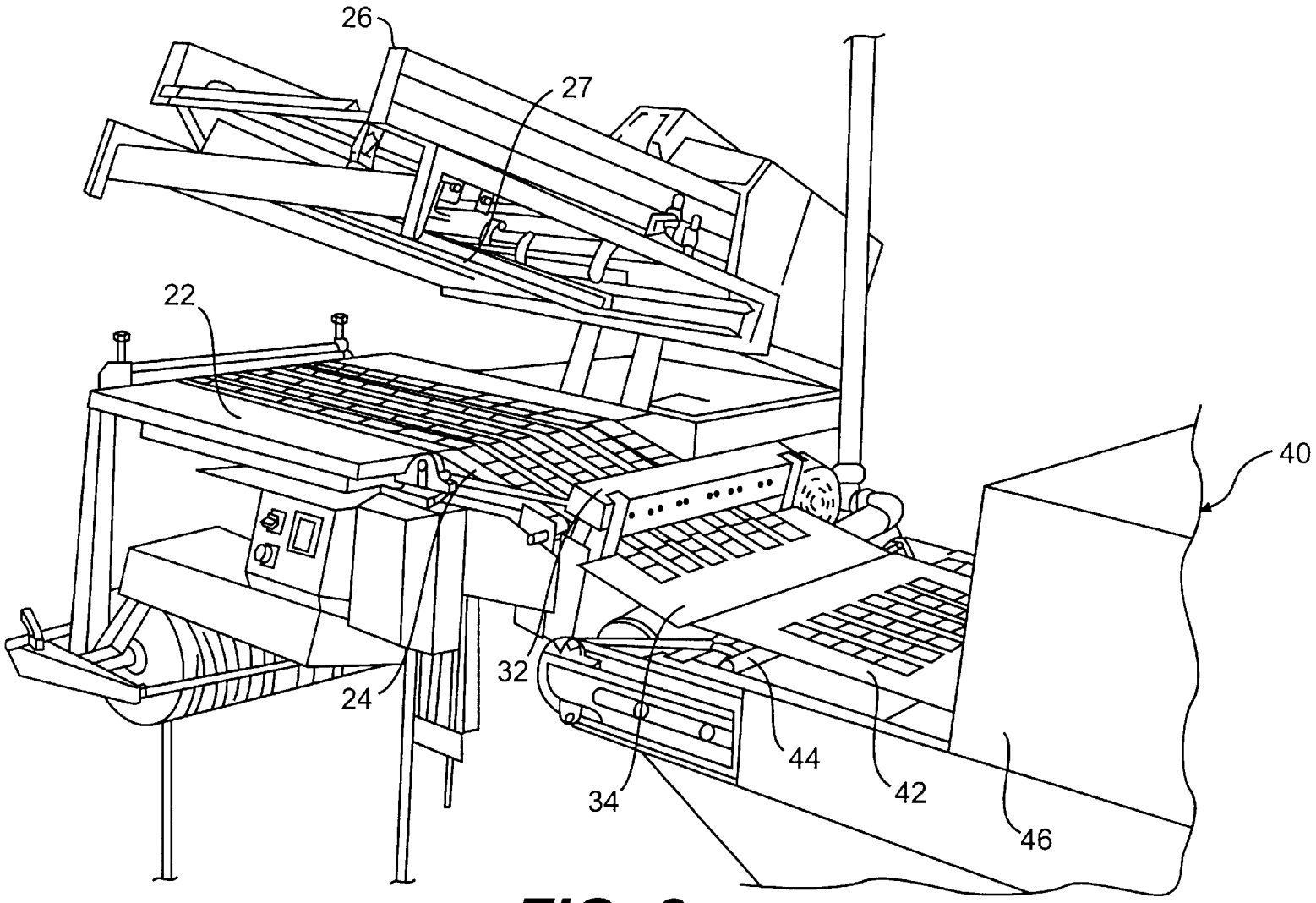
FIG. 3 is a detailed schematic representation of a portion of the process shown in FIG. 1.

Turning to FIG. 3, once the tape has advanced the desired distance onto the printing table, a printing head 26, including a printing screen 27, lowers onto the tape. The screen 27 is generally formed of nylon or polyester, with its mesh closed by a coating which is selectively perforated with minute pores in a desired pattern. The print head 26 holds ink, discussed later, over the screen. When the screen advances to contact the tape, a squeegee forces the ink through the pattern of pores in the screen onto the tape. During this process, a vacuum under the print table draws air through the table perforations to hold the tape in place.

Because the polyester tape is not porous, the vacuum under the print table need not produce as much airflow, as compared with satin, in order to hold the tape to the table. In fact, in order to avoid creating a residual vacuum effect that can inhibit proper advancement of the polyester ribbon, the vacuum should be adjusted to draw about 70 to 80 percent less airflow then is required for satin, which is generally in the range of about 50 to 60 cubic feet per minute.

After each print cycle, the printing head 26 retracts from the tape into the position shown in FIG. 3. At this time, the vacuum under the print table 22 deactivates, and a vacuum under the take-off belt 24 activates, preferably by means of a valve actuated by the movement of the print head. As with the vacuum under the print table, the airflow from the vacuum under the take-off belt can be significantly reduced, as compared to the airflow of about 50 to 60 cubic ft/min that normally must be used in satin ribbon production. Because unlike with the vacuum under the print table, there is not as much concern for residual vacuum effects, it should be reduced only by about 40 percent. This reduced airflow is sufficient to take advantage of the improved characteristics of the polyester tape to enhance the performance of the take-off belt 24 as it pulls the tape taut across the print table 22 before printing and helps advance the tape off the print table 22 after printing. However, this airflow should not be enough to cause the take-off belt 24 to pull the tape through the feed rollers 70.

The feed rollers 70 and the take-off belt combine to advance the tape, newly printed with still-wet ink, past a cutting head 32 by the desired ten inches, simultaneously advancing the next ten inches of tape onto the print table for printing. The timing of all of the above-described rollers, belts, vacuum systems, and the cutting head must be maintained, and it can be provided generally by cams and valves in a manner well known in the art.

As the tape advances into cutting position through the cutting head 32, the forward-most end of the tape will preferably extend across a slide 34 onto a conveyor belt 42. The conveyer belt 42 is preferably formed of about one-quarter inch thick mesh fiber, coated with a non-stick coating such as polytetrafluoroethylene or the like. Preferably, a stationary vacuum bar 44 will be located under the conveyor belt 42 at the point to which the tape extends. This vacuum bar 44 holds the tape against the conveyor belt 42, which keeps the tape taut for cutting and assures that, once cut, the ribbon will be initially drawn downstream by the conveyor belt 42.

The cutting head 32 preferably employs a pair of opposing blades which cooperate to shear the tape across its width. The blades can be scalloped in a manner known in the art, so as to cut a pattern across each end of each ribbon. The PET of the preferred embodiment is tougher to cut that the traditional satin tape. Therefore, even though the satin tape is generally thicker (between five and six mils), the blades of the cutting head 32 should be closer together by about one or two mils in order to effectively cut the three mil polyester. Also, the blades should be kept sharper than is necessary with the satin.

Once cut, the still-wet ribbon advances on the belt 42 to the drying station 40 in which the ink is dried, preferably in a heating chamber 46. The heating chamber preferably employs heating elements and a blower system that moves warm air over the ribbons. Six 220-volt infrared heating elements are employed in a twelve-foot long chamber in the preferred embodiment. The temperature can be thermostatically controlled, and the airflow on the blower can be rheostaticly adjusted. The belt speed can also be changed.

The temperature, blower, and belt-speed settings are chosen to maximize production speed while permitting complete drying without damaging the ribbon. For a given ink, the faster the belt speed, the higher the temperature and/or the blower setting should be to assure complete drying. Obviously, to maximize production, the belt speed should be as high as practical, and should be at least fast enough to keep up with the ribbons as they are being printed and cut. However, the temperature should not exceed those acceptable for the material properties of the ribbon, and the blower speed should not be high enough to blow the ribbon off the belt, given that individual ribbons are at this point being held to the belt only by their own weight.

In order to maintain the desired production levels, the speed of the dryer conveyer belt 42 is preferably approximately 25 to 30 feet per minute. With satin, the temperature in the heating chamber can be approximately 350° F. However, this temperature would cause polyester to wrinkle, and the temperature should instead be in the range of about 265 to 280° F., preferably approximately 275° F.

Figure 4:
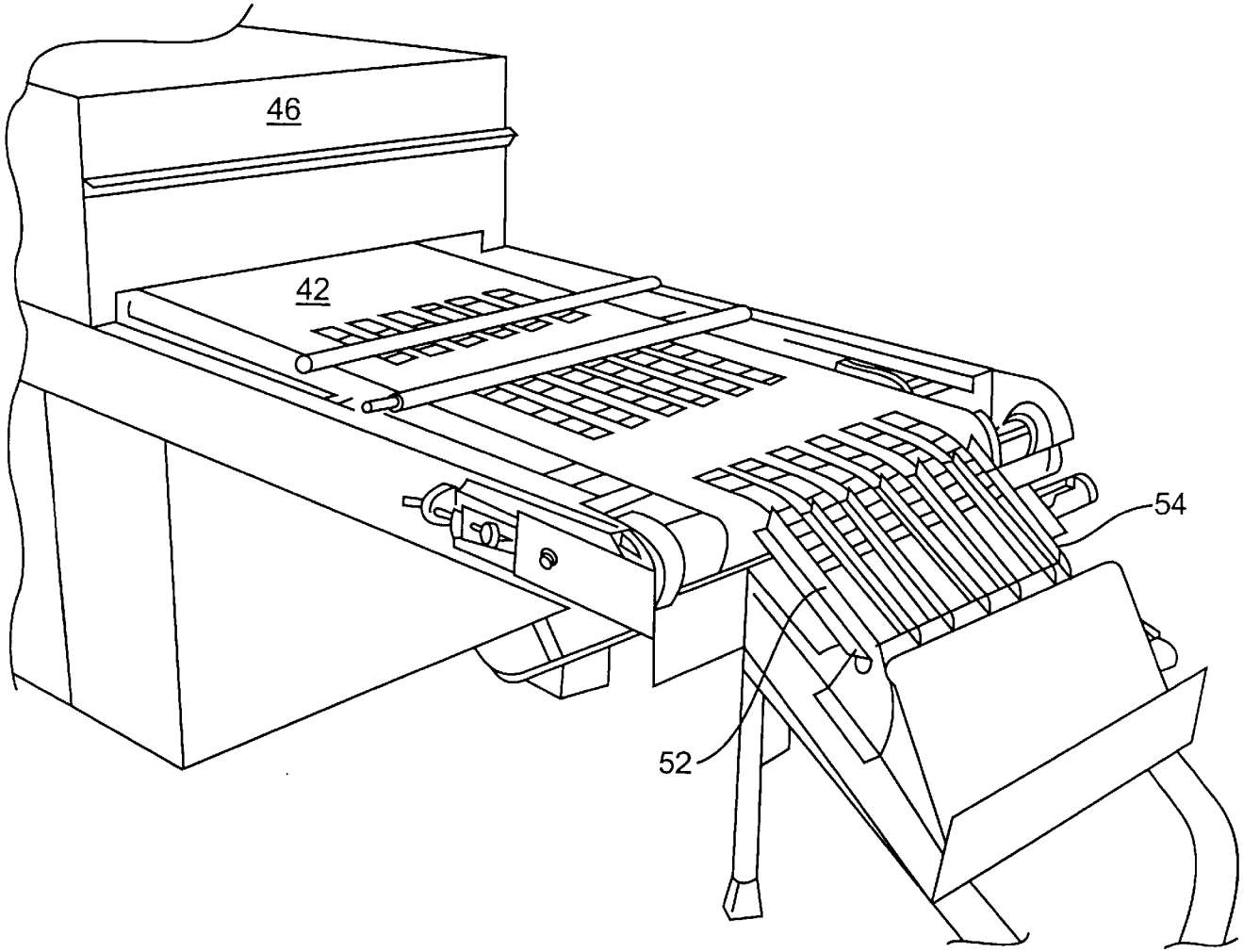
FIG. 4 is a detailed schematic representation of a portion of the process shown in FIG. 1.

Turning to FIG. 4, the ribbons exit the heating chamber and pass from the belt 42 onto a shute 52, which includes stacker guides 54, which funnel the ribbons into neat stacks. The stacks of ribbons are gathered by hand and put into boxes, with each order of ribbons being individually stacked neatly in a small cardboard box.

Figure 5:
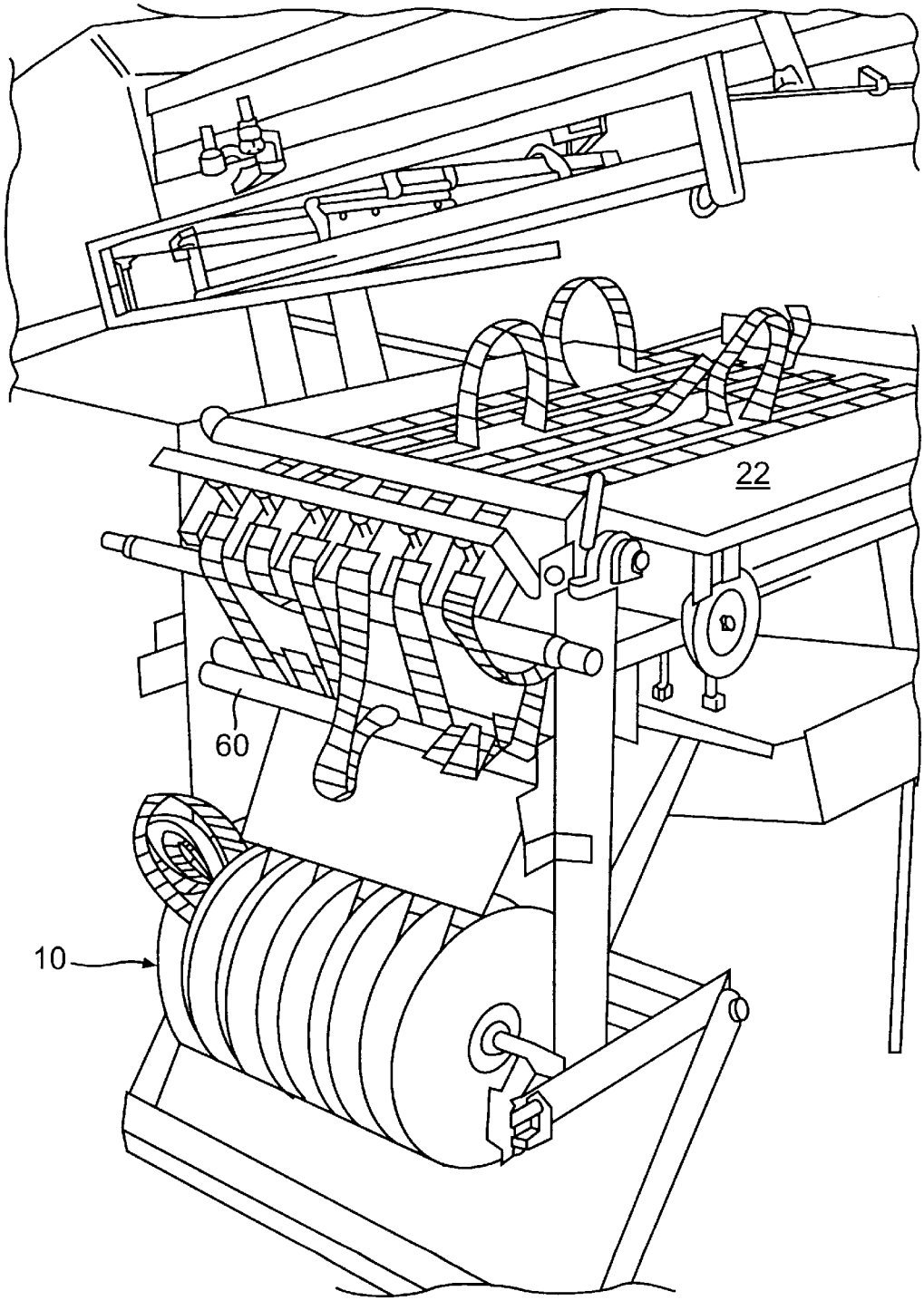
FIG. 5 is a schematic illustration of some static-related problems that can occur in the portion of the process illustrated in FIG. 2.
Figure 6:
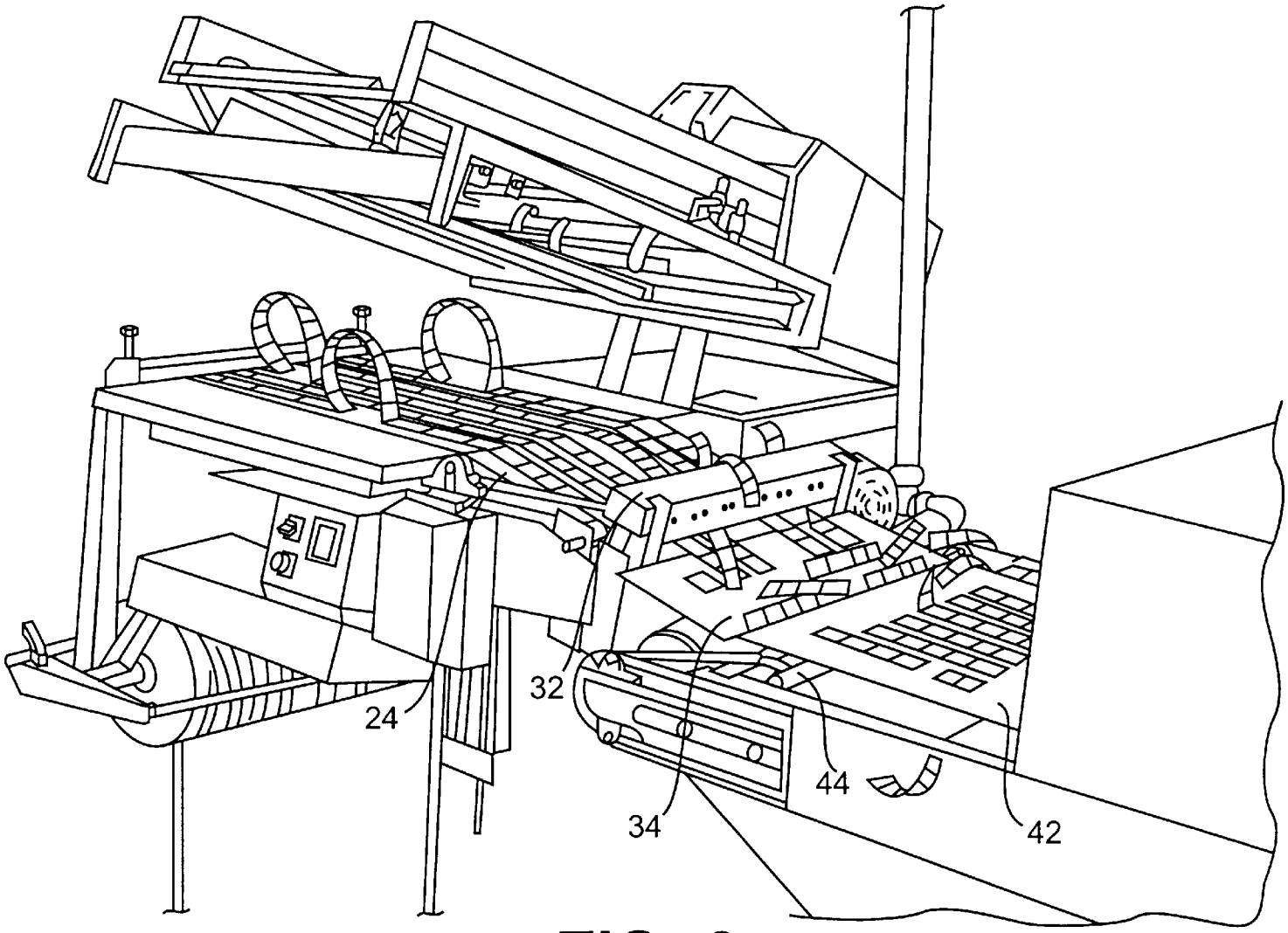
FIG. 6 is a schematic illustration of same static-related problems that can occur in the portion of the process illustrated in FIG. 3.
Figure 7:
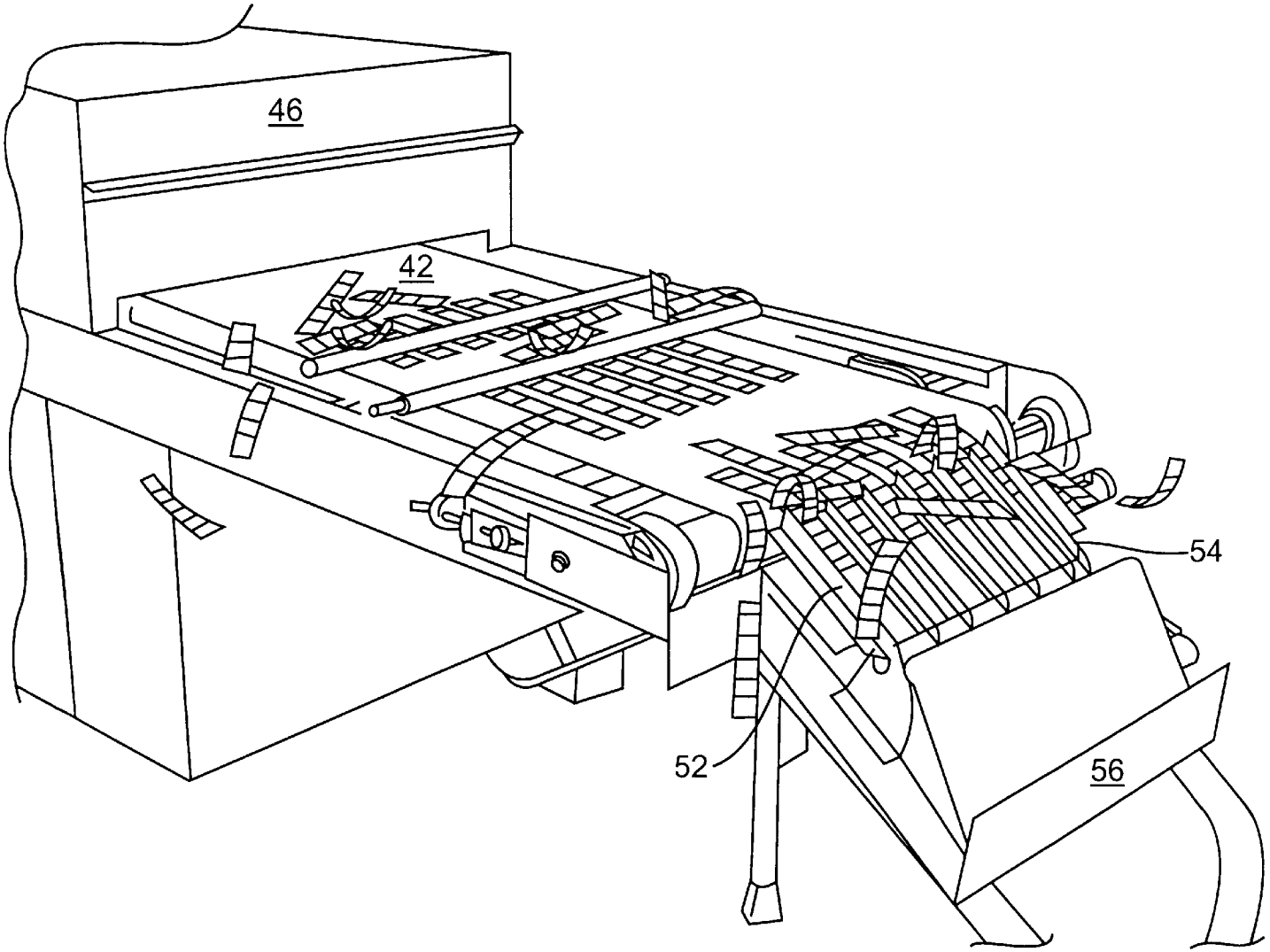
FIG. 7 is a schematic illustration of same static-related problems that can occur in the portion of the process illustrated in FIG. 4.

FIGS. 5 through 7 illustrate some the ways in which the tape can behave in this operation if static electricity is not adequately controlled. As discussed earlier, the timing of the operation is important, requiring the feed rollers to advance ten inches of tape per print cycle, in synchronization with the operation of the print head. The print table vacuum incrementally activates to hold the ribbon in place as the print head lowers and prints. After the print head has applied ink to the tape and starts to retract, the vacuum under the print table deactivates and the vacuum under the take-off belt 24 activates. Shortly thereafter, once the tape has advanced another ten inches, the cutting head is cycled once to cut off the forward end of the tape, thus yielding a ribbon. If an excess of static electricity builds up on the tape, the timing of the tape advancement can be thrown off. If that happens, the operation will fail, either producing jammed machinery or worthless ribbons.

FIG. 5 illustrates how, as the take-off rollers 60 feed the tape off the spools, if there is too much of a build-up of static electricity, that can cause the tape to stick to itself in the spools 10, as well as stick to the rollers 60. This will cause the tape to wind back on the spools or around the rollers. Further, the tape can cling to the print table 22, and thus will not advance properly. As the feed rollers advance the tape incrementally, the tape can begin to loop and curl, preventing proper printing.

FIG. 6 shows the ribbon as it advances past the cutting head 32 onto the drying belt 42. As discussed, if the take-off belt 24 feeds the tape properly across the slide 34 to the conveyor belt 42, the vacuum bar 44 under the drying belt will hold the ribbon in alignment. However, static build-up can cause the tape to cling to the slide 34. This prevents the tape from properly feeding past the cutting head 32, resulting in uneven cuts and worthless ribbons. Also, once cut, the still-wet ribbons can cling to the cutting head 32 or the slide 34, again interrupting the process and usually smudging the ink, rendering more ribbons worthless.

Turning to FIG. 7, as the ribbons ride downstream on the belt 42, they pass over metal bars that support the belt. The ribbons at this point weigh generally less than five-hundredths of an ounce, and any excess static charge can cause the ribbons to be repelled by the bars or one another and jump out of alignment, causing a jam at the stacker at the terminal end of the belt.

Another potential problem illustrated in this Figure is with the stacker itself. As the ribbons pass from the belt 42 through the aluminum shute 52 into a stacking tray 56, excess static can cause the ribbons to cling to the shute. Instead of stacking neatly, the ribbons will back up in the shute, causing a jam.

In order to reduce the effects of static electricity, static neutralizing bars can be employed throughout the process. Returning briefly to FIG. 1, when processing traditional satin ribbons, a pair of static bars 80, 81 are positioned immediately upstream and downstream of the heating chamber 46, one above and one below the conveyor belt 42. In the preferred embodiment with the polyester ribbons, additional pairs of static bars 82, 84 are situated just downstream of the take-off rollers and sandwiching the belt 42 downstream of the heating chamber 46, respectively. An additional static bar (not shown) is preferably positioned below the belt 42 opposite the static bar 81, and one more static bar 88 is positioned above the shute 52 at the stacking station 50. In addition, a portable ionizing air blower, such as Aerostat® Phoenix™ extended range ionizing air blower from Simco, can be set at the downstream end of the chamber 46 (indicated at 86) to blow down on the belt 42 to further reduce static. An ionizing air blower combines an ionizer with a fan to produce a stream of ionized air, and operates under the same principles as the static bars. These measures are sufficient when preparing printed ribbons from double-metallized polyester tape, as used in the preferred process of the present invention. With the preferred process applied to the preferred tape, production levels can be maintained at acceptable levels, without having to dedicate additional operators to closely monitor the process in case of a jam and to individually pick up, sort and stack stray ribbons. However, use of such static-control equipment is not sufficient in the case of single-metallized vinyl.

By way of comparison, the above-described process has been applied to tape formed of a material generally employed in traditional decorating and gift-wrap industries, a 1.2-mil single-metallized vinyl. This material results in ribbons which are aesthetically appealing and have good weight, stiffness and feel. However, from a production perspective, this material is light and flimsy, and therefore does not lend itself to being easily pushed or stacked. In addition, static electricity poses such a great problem that, combined with the light weight of the ribbons, production is completely impractical due to continuous machine jams and lost production time.

Another comparative example, 8-mil vinyl, metallized on one side, has been applied to the ribbon production process. The 8-mil vinyl is workable as far as feeding, stacking, and printing, primarily due to its high stiffness. However, this material is difficult to cut, and the final product is so stiff that it resembles a sheet of plastic more than a ribbon. Even with the 8-mil vinyl, metallized on one side, static electricity is a major problems in production, even with the above-discussed increased number of static bars and the addition of the ionized blower.

4-mil vinyl, metallized on one side, provides a nice compromise in weight and feel between the 1.2-mil and 8-mil vinyls discussed above. However, even with the added static elimination measures discussed above, during production runs static electricity builds up to unworkable levels, causing numerous jams and large losses in production time.

From an aesthetic standpoint, it is irrelevant which surface of the single-metallized tape is printed. However, attempts to process the 4-mil vinyl tape with the metallized side exposed for printing have been largely unsuccessful. The static simply prevents the advancement of the tape.

Even when processing the tape with the nonmetallized side exposed for printing, extreme measures must be employed to prevent problems and complete the process. Even with eight static elimination bars and an ionized air blower, jams are frequent and much material is lost due to improper printing or cutting. Three people, in addition to the operator of the printing head, are required per printer to take the ribbons off of the belt and stack them in boxes, whereas one person can catch for two printers when using double-metallized polyester tape, a six-fold increase in the number of people that must be dedicated to this task. In addition to labor demands, compared to the double-metallized polyester tape, the 4-mil vinyl (the most workable single-metallized vinyl tape) resulted in, by a conservative estimate, more than twice the down time and more than three times the material waste.

It is preferred that the ink used in the screen printing system of the present invention dry quickly enough at relatively low temperatures to permit the heating chamber to be kept in the neighborhood of 275° F., acceptable for the polyester ribbons. One such ink is an ethyl cellulose lacquer-based ink, such as the Series 5500 flat poster inks by Nazdar Company. With this ink, the airflow setting need not be set too high when working at temperatures around 275° F., thereby not blowing the ribbons out of alignment. The adhesion of this ink to the tape is not quite as good as some other commercially available inks, but it is acceptable for this application.

A number of inks have been tested and found to be unsatisfactory for this application as well. For example, the flat vinyl inks utilized with satin ribbons, the Series 3900 inks by Colonial Printing Ink Corporation, do not adhere well to the metallized polyester. On the other hand, screen inks, such as a vinyl inks of the Colonial C33 Series, have proven to be problematic for other reasons. This type of ink adheres very well to the ribbon, but does not dry quickly enough at low enough temperatures to sustain acceptable production levels. In order for this ink to dry with the belt 42 moving at an acceptably fast speed, the temperature in the chamber must be maintained at around 400° F., with an increased airflow. In tests with the 4-mil vinyl ribbon, the ribbons wrinkled and curled badly at this temperature, and the airflow tended to blow the ribbons around in the dryer.

Acrylic resin inks, such as the 9700 Series inks by K. D. Coatings Inc., dry better and permit the use of somewhat reduced blower speeds and temperatures. However, even at drying chamber temperatures of around 325 to 350° F., which are still higher than preferred, the belt speed has to be reduced below desired production speeds, in order to achieve adequate drying.

It is believed that the C33 and 9700 inks can be made to work in the process of the present invention, but they would require a longer heating chamber in order to permit drying at lower temperatures while keeping belt speeds at acceptable levels.

With the double-metallized 3-mil polyester, production speeds can be more than doubled in comparison to the 4-mil single-metallized vinyl. In addition, the number of operators required to process the ribbon orders are no more than as for the satin ribbons. This material eliminates down time due to jammed machines. Anecdotal accounts conservatively estimate that at least 60 percent of the down time and 70 percent of material waste is eliminated by using the double-metallized polyester rather than the 4-mil single-metallized vinyl. Use of the ethyl cellulose lacquer ink in combination with the preferred tape permits the ink to dry at sufficiently high belt speeds to further facilitate production.

Although specific embodiments of the present invention have been described above in detail, it will be understood that this description is merely for purposes of illustration. Various modifications of and equivalent structures corresponding to the disclosed aspects of the preferred embodiments in addition to those described above may be made by those skilled in the art without departing from the spirit of the present invention, which is defined in the following claims. For example, the above-described process can be modified so that the printed tape is dried prior to being cut into ribbons. Accordingly, the scope of the claims is to be accorded the broadest interpretation so as to encompass such modifications and equivalent structures.

What is claimed is:

1. In a process of forming a plurality of substantially identical printed ribbons, which comprises:

a) providing a length of rolled tape, b) unrolling the tape, c) repeatedly silk-screen printing a wet ink pattern onto a side of the tape, as the tape is unrolled, d) cutting the printed tape into a plurality of ribbons all having substantially the same length and all bearing substantially the same ink pattern, and e) drying the wet ink pattern, the improvement wherein the tape that is used is comprised of a polymer substrate that is metallized on both sides, with at least the side that is printed upon having a top layer of an ink-receptive coating upon which, in step (c), the wet ink pattern is printed.

2. The process according to claim 1, wherein the polymer substrate comprises a polyester film having a thickness in the range of approximately 2 to 4 mils.

3. The process according to claim 2, wherein the polyester film primarily comprises polyethylene terephthalate.

4. The process according to claim 2, wherein the thickness of the polyester film is approximately 3 mils.

5. The process according to claim 1, wherein the polymer substrate is metallized by vacuum depositing aluminum onto the polymer substrate.

6. The process according to claim 1, wherein the ink-receptive coating comprises a polyurethane.

7. The process according to claim 6, wherein the polyurethane is pigmented.

8. The process according to claim 1, further comprising the steps of (i) incrementally feeding the unrolled tape onto a porous print table for the printing of the wet ink pattern, and (ii) drawing air through pores in the print table in order to hold one of the two sides of the tape to the print table as the printing occurs.

9. The process according to claim 8, further comprising the step of, prior to feeding the unrolled tape onto the print table, exposing the unrolled tape to ionized air in order to reduce static.

10. The process according to claim 1, wherein the ink comprises an ethyl cellulose lacquer.

11. The process according to claim 1, further comprising the step of, prior to drying the wet ink pattern, exposing the ribbon to ionized air in order to reduce static.

12. The process according to claim 1, wherein the wet ink pattern is dried by heating.

13. The process according to claim 12, wherein the heating is accomplished in a heating chamber in which the temperature is less than 350° F.

14. The process according to claim 13, wherein the temperature in the heating chamber is in the approximate range of 265 to 280° F.

15. The process according to claim 14, wherein the temperature in the heating chamber is approximately 275° F.

16. A printed ribbon produced by the process according to claim 1.

17. In a printed ribbon which comprises:

a ribbon substrate; and an ink pattern silk-screen printed onto a side of the ribbon substrate, the improvement wherein the ribbon substrate comprises a polymer substrate that is metallized on both sides with an ink-receptive coating disposed at least on the side that is printed upon and upon which the ink pattern is printed.

18. The printed ribbon according to claim 17, wherein the polymer substrate comprises a polyester film.

19. The printed ribbon according to claim 18, wherein the polyester primarily comprises polyethylene terephthalate.

20. The printed ribbon according to claim 18, wherein the polymer substrate has a thickness in the range of approximately 2 to 4 mils.

21. The printed ribbon according to claim 20, wherein the thickness of the polymer substrate is approximately 3 mils.

22. The printed ribbon according to claim 17, wherein the polymer substrate is metallized with aluminum.

23. The printed ribbon according to claim 22, wherein the aluminum is vacuum deposited on the polymer substrate.

24. The printed ribbon according to claim 17, wherein the ink-receptive coating comprises a polyurethane.

25. The printed ribbon according to claim 24, wherein the polyurethane is pigmented.

26. The printed ribbon according to claim 17, wherein the ink comprises an ethyl cellulose lacquer.

* * * * *